US011441330B2

(12) United States Patent
Jeng et al.

(10) Patent No.: US 11,441,330 B2
(45) Date of Patent: Sep. 13, 2022

(54) ELECTRONIC LOCK AND INPUT APPARATUS THEREOF

(71) Applicant: TONG LUNG METAL INDUSTRY CO., LTD., Minxiong Township (TW)

(72) Inventors: Ruei-Jie Jeng, Jhuci Township (TW); Chih-Han Wu, Minxiong Township (TW); Chen-Ming Lin, Minsyong Township (TW); Chun-Yi Fang, Huwei Township (TW)

(73) Assignee: Tong Lung Metal Industry Co., Ltd., Minxiong Township (TW)

( * ) Notice: Subject to any disclaimer, the term of this patent is extended or adjusted under 35 U.S.C. 154(b) by 336 days.

(21) Appl. No.: 16/898,884

(22) Filed: Jun. 11, 2020

(65) Prior Publication Data

US 2020/0392757 A1 Dec. 17, 2020

(30) Foreign Application Priority Data

Jun. 13, 2019 (TW) ..... 108120439

(51) Int. Cl.
*E05B 47/00* (2006.01)
*G07C 9/00* (2020.01)

(52) U.S. Cl.
CPC ..... *E05B 47/0001* (2013.01); *G07C 9/00182* (2013.01); *E05B 2047/0054* (2013.01); *E05B 2047/0071* (2013.01); *G07C 2009/00222* (2013.01)

(58) Field of Classification Search
CPC ..... E05B 47/0001; E05B 2047/0054; E05B 2047/0071; E05B 47/02; E05B 2047/0065; G07C 9/00182; G07C 2009/00222; G07C 9/0069; G07C 2009/00642
USPC ..... 340/5.7; 70/277
See application file for complete search history.

(56) References Cited

U.S. PATENT DOCUMENTS 5,151,554 A * 9/1992 Matsuda ..... H03M 11/20 341/26
5,430,443 A * 7/1995 Mitchell ..... H03M 11/003 341/26
5,677,687 A * 10/1997 Valdenaire ..... H03M 11/20 341/26
5,872,561 A * 2/1999 Figie ..... G06F 3/045 341/26
6,020,833 A * 2/2000 Chang ..... H03M 11/20 341/26

(Continued)

*Primary Examiner* — Nam V Nguyen
(74) *Attorney, Agent, or Firm* — Michael Best & Friedrich LLP

(57) ABSTRACT

An electronic lock includes an input apparatus. The input apparatus includes a keypad module and a processor module. The keypad module includes plural button devices arranged in plural rows and in plural columns. The processor module includes a signal-processing unit configured to, when operating in a work mode, repeatedly perform an emission process of inputting a detection signal to each column of button devices, and repeatedly perform a scan process to detect, for each row of button devices, the detection signal outputted from any row of button devices. The detection signal includes a pulse wave composed of plural pulses. The signal-processing unit is further configured to generate and output an input signal corresponding to one of the button devices when detecting the detection signal.

16 Claims, 3 Drawing Sheets

(56) References Cited

U.S. PATENT DOCUMENTS

| | | | | |
|---|---|---|---|---|
| 6,295,282 | B1 * | 9/2001 | Buer | H04B 7/2041 340/2.2 |
| 6,359,547 | B1 * | 3/2002 | Denison | B60R 25/102 340/663 |
| 8,258,985 | B2 * | 9/2012 | Huang | G06F 3/0202 341/26 |
| 9,122,871 | B2 * | 9/2015 | Bellahcene | G06F 21/83 |
| 9,372,547 | B2 * | 6/2016 | Bellahcene | G06F 21/83 |
| 9,575,580 | B2 * | 2/2017 | Nurmi | G06F 3/0416 |
| 2013/0249714 | A1 * | 9/2013 | Ho | H03M 11/20 341/22 |

* cited by examiner

ELECTRONIC LOCK AND INPUT APPARATUS THEREOF

CROSS-REFERENCE TO RELATED APPLICATION

This application claims priority of Taiwanese Invention Patent Application No. 108120439, filed on Jun. 13, 2019.

FIELD

The disclosure relates to an input apparatus, and more particularly to an input apparatus for an electronic lock.

BACKGROUND

A conventional electronic lock uses full-power scan to detect user operations on a touch panel thereof. That is, a high-level signal that has a predetermined duration is inputted to each touch button of the touch panel in order to detect operation performed on any of plural touch buttons of the touch panel during a time period corresponding to the predetermined duration. Such full-power scan approach consumes much power. Electronic locks usually use independent power sources, such as batteries, to avoid malfunction due to power outages. Because of lack of power efficiency, batteries of said conventional electronic lock using full-power scan need to be replaced frequently. Such frequent replacement of the batteries brings inconvenience to the users.

SUMMARY

Therefore, an object of the disclosure is to provide an electronic lock and an input apparatus therefor that can alleviate at least one of the drawbacks of the prior art.

According to one aspect of the disclosure, an input apparatus for an electronic lock includes a keypad module, and a processor module in communication with said keypad module. The keypad module includes plural button devices each being operable to output a detection signal. The button devices are arranged in plural rows extending in a first direction and in plural columns extending in a second direction. The processor module includes a signal-processing unit, a sleep unit and a wake-up unit. The signal-processing unit is configured to switch between a sleep mode and a work mode. The signal-processing unit is further configured to, when operating in the work mode, repeatedly perform an emission process of inputting the detection signal to each column of the button devices. In the emission process, the signal-processing unit is to input the detection signal to each column from a first column of the plural columns of the button devices to a last column of the plural columns of the button devices in an order in the first direction. The detection signal includes a pulse wave composed of plural pulses. The signal-processing unit is configured to cease performing the emission process in the sleep mode. The signal-processing unit is further configured to, when operating in the work mode, repeatedly perform a scan process to detect whether the detection signal is outputted from one row of the plural rows of the button devices. The scan process is performed each time the detection signal is inputted to one of the columns of the button devices. In the scan process, the signal-processing unit is to, for each row from a first row of the plural rows of the button devices to a last row of the plural rows of the button devices in an order in the second direction, attempt to receive the detection signal from the row of the button devices. The signal-processing unit is further configured to, when operating in the work mode and when the detection signal outputted from one row of the button devices is detected while the signal-processing unit is inputting the detection signal to one column of the button devices, generate an input signal corresponding to one of the button devices that is located in the one row of the button devices and also in the one column of the button devices, and output the input signal thus generated. The sleep unit configured to switch the signal-processing unit from the work mode to the sleep mode when no input signal has been outputted by the signal-processing unit fora predetermined time period. The wake-up unit is configured to switch the signal-processing unit from the sleep mode to the work mode when receiving an activation signal.

According to one aspect of the disclosure, an electronic lock includes an input apparatus, a lock mechanism, and an electronic controller device in communication with the input apparatus and the lock mechanism. The input apparatus includes a keypad module, and a processor module in communication with the keypad module. The keypad module includes plural button devices each being operable to output a detection signal. The button devices are arranged in plural rows extending in a first direction and in plural columns extending in a second direction. The lock mechanism is configured to be electrically driven to switch between a lock state and an unlock state. The electronic controller device is configured to store a predetermined password, to receive a series of input signals from the input apparatus during a time period to compose an input password based on the input signals, to compare the input password with the predetermined password, and to drive, when the input password matches the predetermined password, the lock mechanism to switch from the lock state to the unlock gate. The processor module includes a signal-processing unit, a sleep unit and a wake-up unit. The signal-processing unit is configured to switch between a sleep mode and a work mode. The signal-processing unit is further configured to, when operating in the work mode, repeatedly perform an emission process of inputting the detection signal to each column of the button devices. In the emission process, the signal-processing unit is to input the detection signal to each column from a first column of the plural columns of the button devices to a last column of the plural columns of the button devices in an order in the first direction. The detection signal includes a pulse wave composed of plural pulses. The signal-processing unit is configured to cease performing the emission process in the sleep mode. The signal-processing unit is further configured to, when operating in the work mode, repeatedly perform a scan process to detect whether the detection signal is outputted from one row of the plural rows of the button devices. The scan process is performed each time the detection signal is inputted to one of the columns of the button devices. In the scan process, the signal-processing units to, for each row from a first row of the plural rows of the button devices to a last row of the plural rows of the button devices in an order in the second direction, attempt to receive the detection signal from the row of the button devices. The signal-processing unit is further configured to, when operating in the work mode and when the detection signal outputted from one row of the button devices is detected while the signal-processing unit is inputting the detection signal to one column of the button devices, generate one of the input signals corresponding to one of the button devices that is located in the one row of the button devices and also in the one column of the button devices, and output the one of the input signals thus generated to the electronic controller device. The sleep unit is configured to switch the signal-processing unit from the work mode to the sleep mode when no input signal has been outputted by the signal-processing unit for a predetermined time period. The wake-up unit is configured to switch the signal-processing unit from the sleep mode to the work mode when receiving an activation signal.

BRIEF DESCRIPTION OF THE DRAWINGS

Other features and advantages of the disclosure will become apparent in the following detailed description of the embodiment(s) with reference to the accompanying drawings, of which.

DETAILED DESCRIPTION

Figure 1:
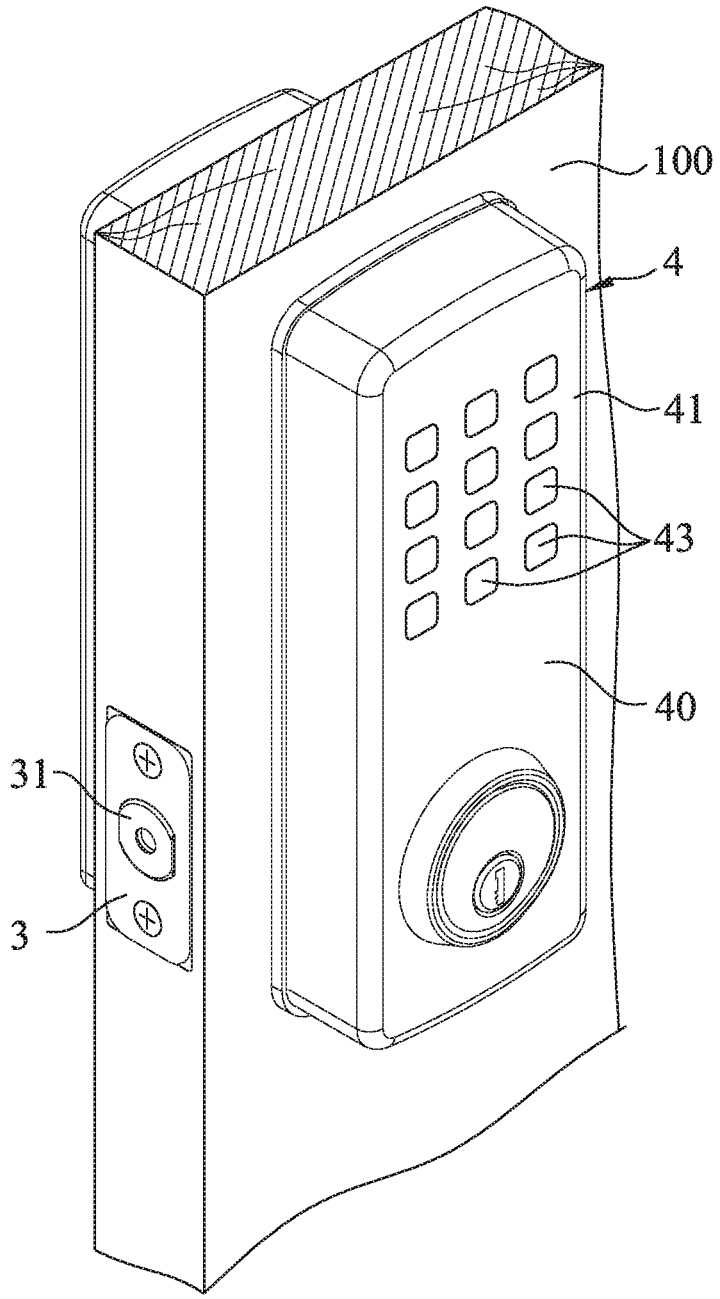
FIG. 1 exemplarily illustrates a perspective view of an electronic lock installed on a door leaf according to an embodiment of the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

A power-saving electronic lock is provided in this disclosure. FIG. 1 exemplarily illustrates a perspective view of the electronic lock installed on a door leaf 100, and FIG. 2 exemplarily illustrates a block diagram of the electronic lock.

Figure 2:
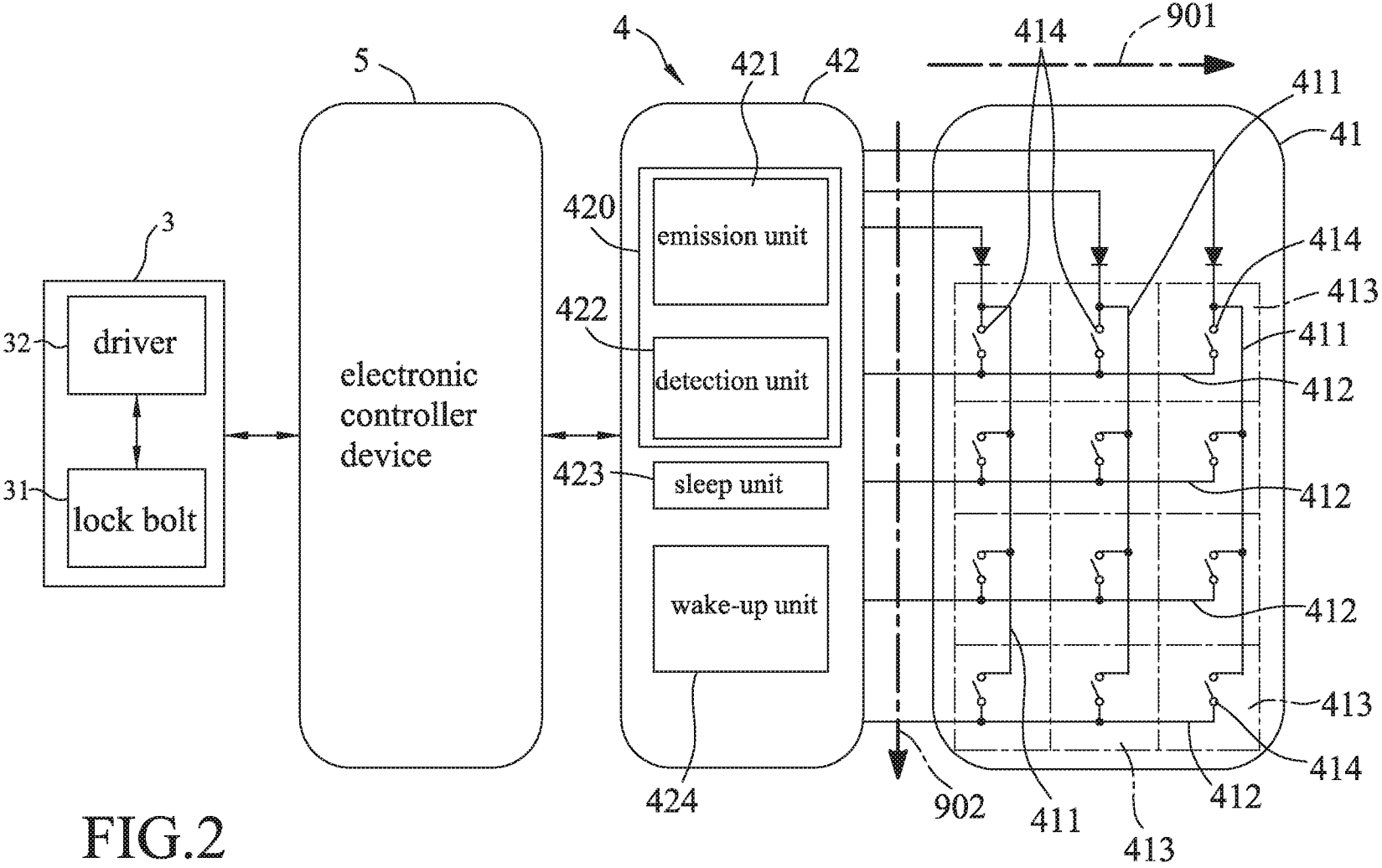
FIG. 2 exemplarily illustrates a block diagram of the electronic lock according to an embodiment of the disclosure.

Referring to FIGS. 1 and 2, the illustrated electronic lock includes a lock mechanism 3, an input apparatus 4, and an electronic controller device 5 in communication with both of the lock mechanism 3 and the input apparatus 4. In this embodiment, the electronic controller device 5 is electrically connected to the lock mechanism 3 and the input apparatus 4. The lock mechanism 3 includes a lock bolt 31 (e.g., a deadbolt, a latch bolt, etc.), and a driver 32 (e.g., a motor) that is configured to be electrically driven by the electronic controller device 5 to drive the lock bolt 31 to switch between a lock state and an unlock state. In the lock state, the lock bolt 31 of the lock mechanism 3 protrudes from the door leaf 100 and engages with a door frame (not shown) such that the door leaf 100 is fastened on the door frame; in the unlock state (as illustrated in FIG. 1), the lock bolt 31 of the lock mechanism 3 is retracted into the door leaf 100 such that the door leaf 100 can be opened relative to the door frame. The structures and appearances of the lock mechanism 3 and the input apparatus 4 as illustrated in FIG. 1 are shown for exemplification only, and do not limit the scope of the disclosure.

Referring to FIG. 2, the input apparatus 4 includes a keypad module 41, and a processor module 42 in communication with the keypad module 41. The keypad module 41 includes plural button devices 414 that are arranged in plural rows extending in a first direction 901 and in plural columns extending in a second direction 902 that is perpendicular to the first direction 901. In FIG. 2, twelve button devices 414 that are arranged in a 4×3 array (having four rows and three columns) are illustrated, but the disclosure is not limited thereto. Specifically, the keypad module 41 further includes plural column conducting lines 411 (e.g., three in FIG. 2) that extend in the second direction 902 and that are spaced apart from each other in the first direction 901, and plural row conducting lines 412 (e.g., four in FIG. 2) that extend in the first direction 901 and that are spaced apart from each other in the second direction 902. The column conducting lines 411 correspond respectively to the columns of button devices 414, and the row conducting lines 412 correspond respectively to the rows of button devices 414. Each of the column conducting lines 411 passes across but does not electrically connect to each of the row conducting lines 412. Each of the intersections of the column conducting lines 411 and the row conducting lines 412 defines a button area 413 in its periphery on the keypad. module 41. Each of the button devices 414 corresponds to a different button area 413. That is, each of the button devices 414 corresponds to a different combination of one of the column conducting lines 411 (referred to "corresponding column conducting line 411" hereinafter) and one of the row conducting lines 412 (referred to as corresponding row conducting line 412" hereinafter). Each of the button devices 414 is disposed in the button area 413 defined by the intersection of its corresponding column conducting line 411 and its corresponding row conducting line 412, and is electrically connected to its corresponding column conducting line 411 and its corresponding row conducting line 412. The button devices 414 are each operable (e.g., as a switch) to electrically connect the corresponding column conducting line 411 and the row conducting line 412, such that a signal (e.g., a detection signal) received from the corresponding column conducting line 411 may be transmitted to the corresponding row conducting line 412, and be outputted on the corresponding row conducting line 412. According to some embodiments, the input apparatus 4 may include plural buttons 43 (exemplified in FIG. 1) that are positioned on an outer surface 40 of the input apparatus 4, that correspond respectively to the button devices 414, and that may each be pressed (e.g., in a case that the buttons 43 are physical buttons) or touched (e.g., in a case that the buttons 43 are resistive touch buttons or capacitive touch buttons) by a user to operate the corresponding button device 414 to temporarily and electrically connect the corresponding column conducting line 411 and the corresponding row conducting line 412.

The processor module 412 includes a signal-processing unit 420, a sleep unit 423 and a wake-up unit 424, wherein the signal-processing unit 420 includes an emission unit 421 and a detection unit 422. The processor module 42 may be embedded as a circuit or a system on a chip (SoC), and may at least include, but not limited to, a single core processor, a multi-core processor, a microprocessor, microcontroller, a digital signal processor (DSP), a field-programmable gate array (FPGA), an application specific integrated circuit (ASIC), and/or a radio-frequency integrated circuit (RFIC), etc.

The signal-processing unit 420 has two operation modes including a sleep mode and a work mode, and is configured to switch therebetween. The wake-up unit 424 is configured to switch the signal-processing unit 420 from the sleep mode to the work mode when receiving an activation signal that is related to a user operation of the input apparatus 4, or is related to presence of a user in proximity of the input apparatus 4. According to some embodiments, the activation signal may be generated by a proximity sensor that detects a hand of a user coming near the input apparatus 4, or generated in response to one of the button devices 414 being pressed or touched, but the disclosure is not limited thereto.

When operating in the work mode, the emission unit 421 of the signal-processing unit 420 repeatedly performs an emission process of inputting the detection signal to each column of button devices 414, and the detection unit 422 of the signal-processing unit 420 repeatedly performs a scan process to detect whether the detection signal is outputted from one of the rows of button devices 414. When operating in the sleep mode, the emission unit 421 ceases performing the emission process, and the detection unit 422 ceases performing the scan process.

In the emission process, the emission unit 421 inputs the detection signal to each column from a first one of the columns of button devices 414 (referred to as "first column of button devices 414" hereinafter) to a last one of the columns of button devices 414 (referred to as "last column of button devices 414" hereinafter) in an order in the first direction 901 (i.e., in the illustrations of FIG. 2, from the leftmost column of button devices 414 to the rightmost column of button devices 414). Specifically, the emission unit 421 inputs the detection signal to each column of button devices 414 by inputting the detection signal to one column conducting line 411 that corresponds to the column of button devices 414 (i.e., inputting the detection signal to each column conducting lines 411 from a first one of the column conducting lines 411 (referred to as "first column conducting line 411" hereinafter) to a last one of the column conducting lines 411 (referred to as "last column conducting line 411" hereinafter) in an order in the first direction 901), in order for each button device 414 in the column of button devices 414 to receive the detection signal from said column conducting line 411. The emission unit 421 inputs the detection signal into only one column conducting line 411 at a time.

The scan process is performed each time the detection signal is inputted to one of the columns of button devices 414. In the scan process, the detection unit 422 attempts, for each row from a first one of the rows of button devices 414 (referred to as "first row of button devices 414" hereinafter) to a last one of the rows of button devices 414 (referred to as "last row of button devices 414" hereinafter) in an order in the second direction 902, i.e., in the illustrations of FIG. 2, from the top row of button devices 414 to the bottom row of button devices 414, to receive the detection signal from the row of button devices 414 by receiving the detection signal from one row conducting line 412 corresponding to the row of button devices 414. That is, in the scan process, the detection unit 422 attempts, for each row conducting line 412 from a first one of the row conducting lines 412 (referred to as "first row conducting line 412" hereinafter) to a last one of the row conducting lines 412 (referred to as "last row conducting line 412" hereinafter) in an order in the second direction 902, to receive the detection signal from the row conducting line 412.

Figure 3:
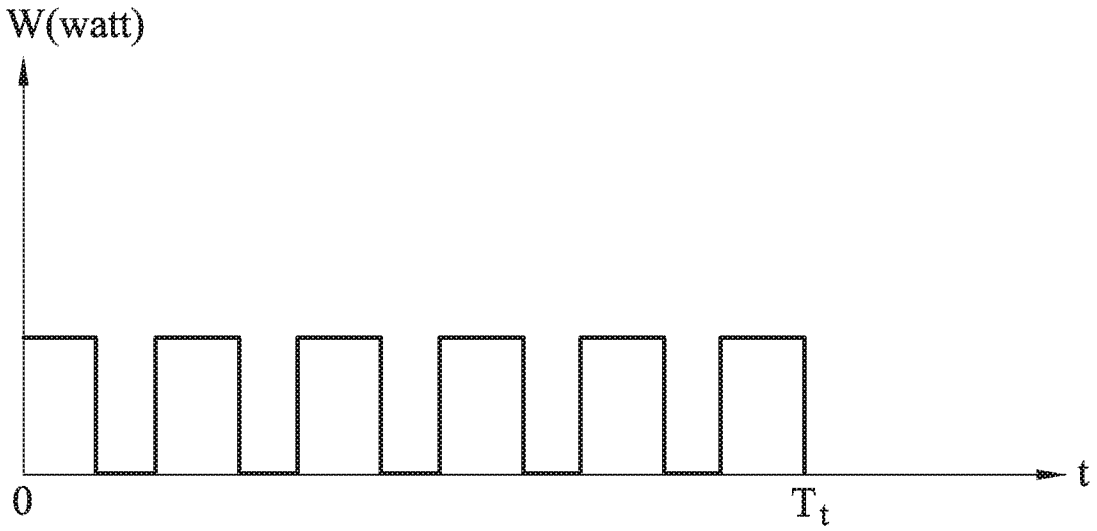
FIG. 3 exemplarily illustrates a waveform of a detection signal according to an embodiment of the disclosure.

The detection signal includes a pulse wave composed of plural pulses. An example of the detection signal is illustrated in FIG. 3. The exemplary detection signal shown in FIG. 3 has six pulses, but the disclosure is not limited thereto. That is, the number of pulses included in the detection signal may also be more than or less than six. The detection signal has a predetermined time duration ($T_t$), and a total pulse width ($T_p$) that is a sum of pulse widths respectively of the plural pulses . For each of the plural pulses, the pulse width thereof is the elapsed time between the rising and falling edges of the pulse (i.e., the duration of the pulse). According to some embodiments, the ratio of the total pulse width ($T_p$) to the predetermined time duration ($T_t$) (i.e., $T_p/T_t$) is preferably between 20% and 50%, because it would be difficult for the detection unit 422 to detect the detection signal on the row conducting lines 412 if the ratio $T_p/T_t$ of the detection signal is less than 20%, and the power-saving effect is insignificant if the ratio $T_p/T_t$ of the detection signal is more than 50%.

When the detection unit 422 detects the detection signal that is outputted from one row of button devices 414 while the emission unit 421 is inputting the detection signal to one column of button devices 414, it means that one of the button devices 414 that is located in said one row and also in said one column has been operated by a user. Therefore, upon detection of the detection signal, the detection unit 422 generates an input signal corresponding to the one button device 414, and outputs the input signal thus generated. Also, upon detection of the detection signal, the detection unit 422 stops performing the scan process that is currently performed, and then start the scan process again from the first row conducting line 412. In addition, the emission unit 421 also stops performing the emission process that is currently performed, and then start the emission process again from the first column conducting line 411 simultaneously with the starting of the scan process.

The sleep unit 423 starts a timer each time the detection unit 422 outputs an input signal. When no input signal has been outputted by the detection unit 422 fora predetermined time period, the sleep unit 423 switches the signal-processing unit 420 from the work mode to the sleep mode to save power.

The described operations of the processor module 42 may be implemented as a method, apparatus or computer readable storage medium using standard programming and/or engineering techniques to produce software, firmware, hardware, or any combination thereof. The described operations may be implemented as code or logic maintained in a "computer readable storage medium", which may directly execute the functions or where a processor may read and execute the code from the computer storage readable medium. The computer readable storage medium includes least one of electronic circuitry, storage materials, inorganic materials, organic materials, biological materials, a casing, a housing, a coating, and hardware. A computer readable storage medium may include, but is not limited to, a magnetic storage medium (e.g., hard disk drives, floppy disks, tape, etc.), optical storage (CD-ROMs, DVDs, optical disks, etc.), volatile and non-volatile memory devices (e.g., EEPROMs, ROMs, PROMs, RAMs, DRAMs, SRAMs, flash memory, firmware, programmable logic, etc.), solid state devices (SSD), etc. The computer readable storage medium may further include digital logic implemented in a hardware device (e.g., an integrated circuit chip, a programmable logic device, a programmable gate array (PGA), field-programmable gate array (FPGA), application specific integrated circuit (ASIC), etc.)

The electronic controller device 5 stores at least one predetermined password in, for example, a memory thereof, and is configured to receive a series of the input signals outputted by the detection unit 422 during a time period to compose an input password based on the input signals, and then compare the input password thus composed with the at least one predetermined password. When the input password matches one of the at least one predetermined password, the electronic controller device 5 drives the driver 32 of the lock mechanism 3 to perform a corresponding operation, e.g., drive the lock bolt 32 to switch from the lock state to the unlock state.

A beneficial characteristic of the disclosed electronic lock with the input apparatus 4 is that, in comparison with the conventional electronic lock using full-power scan approach, the disclosed electronic lock may save about 50% to 80% electrical power used in user-input detection by utilizing a pulse-composed detection signal that has a ratio of the total pulse width ($T_p$) and the predetermined time duration ($T_t$) (i.e., $T_p/T_t$) being between 20% and 50%. In addition, the disclosed electronic lock may save more power with the signal-processing unit 420 that enters the sleep mode (in which no emission process and no scan process is performed) when not being operated by the user for a predetermined time period.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. An input apparatus for an electronic lock, comprising:

a keypad module including plural button devices each being operable to output a detection signal, wherein said button devices are arranged in plural rows extending in a first direction and in plural columns extending in a second direction; and a processor module in communication with said keypad module, said processor module including a signal-processing unit configured to switch between a sleep mode and a work mode, said signal-processing unit being further configured to, when operating in the work mode, repeatedly perform an emission process of inputting the detection signal to each column of said button devices, wherein in the emission process, said signal-processing unit is to input the detection signal to each column from a first column of the plural columns of said button devices to a last column of the plural columns of said button devices in an order in the first direction, the detection signal including a pulse wave composed of plural pulses, wherein said signal-processing unit is configured to cease performing the emission process in the sleep mode, repeatedly perform a scan process to detect whether the detection signal is outputted from one row of the plural rows of said button devices, wherein the scan process is performed each time the detection signal is inputted to one of said columns of said button devices, and wherein in the scan process, said signal-processing unit is to, for each row from a first row of the plural rows of said button devices to a last row of the plural rows of said button devices in an order in the second direction, attempt to receive the detection signal from the row of said button devices, and when the detection signal outputted from one row of said button devices is detected while said signal-processing unit is inputting the detection signal to one column of said button devices, generate an input signal corresponding to one of said button devices that is located in said one row of said button devices and also in said one column of said button devices, and output the input signal thus generated, a sleep unit configured to switch said signal-prosing unit from the work mode to the sleep mode when no input signal has been outputted by said signal-processing unit for a predetermined time period, and a wake-up unit configured to switch said signal-processing unit from the sleep mode to the work mode when receiving an activation signal.

2. The input apparatus of claim 1, wherein the detection signal has a predetermined time duration, and a total pulse width that is a sum of pulse widths respectively of the plural pulses, and wherein the ratio of the total pulse width to the predetermined time duration is between 20% and 50%.

3. The input apparatus of claim 1, wherein:

said keypad module further includes plural column conducting lines that extend in the second direction, that are spaced apart from each other in the first direction and that correspond respectively to the plural columns of said button devices, and plural row conducting lines that extend in the first direction, that are spaced apart from each other in the second direction and that correspond respectively to the plural rows of said button devices, wherein each of said plural column conducting lines passes across said plural row conducting lines;

each of said button devices corresponds to a different combination of one of said plural column conducting lines and one of said plural row conducting lines, is electrically connected to the corresponding one of said column conducting lines and the corresponding one of said row conducting lines, and is operable to transmit the detection signal received from the corresponding one of said column conducting lines to the corresponding one of said row conducting lines by connecting said corresponding column conducting line and said corresponding row conducting line, in order to output the detection signal on said corresponding row conducting line; and said signal-processing unit includes an emission unit configured to repeatedly perform the emission process to input the detection signal to each column of said button devices by inputting the detection signal to one of said column conducting lines that corresponds to the column of said button devices, in order for each of said button devices in the column of said button devices to receive the detection signal from the one of said column conducting lines, and a detection unit configured to repeatedly perform the scan process to detect the detection signal from one row of the rows of said button devices by receiving the detection signal from one of said row conducting lines corresponding, to said one row of said button devices.

4. The input apparatus of claim 3, wherein:

said emission unit is configured to perform the emission process by inputting the detection signal to each column conducting line from a first one of said column conducting lines to a last one of said column conducting lines in an order in the first direction; and said detection unit is configured to perform the scan process by, for each row conducting line from a first one of said row conducting lines to a last one of said row conducting lines in an order in the second direction, attempt to receive the detection signal from the row conducting line, and to stop performing the scan process that is currently performed when receiving the detection signal from said row conducting lines, and then start the scan process again from the first one of said row conducting lines.

5. The input apparatus of claim 4, wherein said emission unit is further configured to stop performing the emission process that is currently performed when said detection unit receives the detection signal from said row conducting lines, and then start the emission process again from the first one of said column conducting lines simultaneously with the starting of the scan process.

6. The input apparatus of claim 1, wherein said signal-processing unit is configured to, when the detection signal outputted from said button devices is detected, stop performing the scan process that is currently performed, and start the scan process again from the first row of the plural rows of said button devices.

7. The input apparatus of claim 6, wherein said signal-processing unit is configured to, when the detection signal outputted from said button devices is detected by said signal-processing unit, stop performing the emission process that is currently performed, and start the emission process again from the first column of the plural columns of said button devices simultaneously with the starting of the scan process.

8. The input apparatus of claim 1, wherein the activation signal is related to one of a user operation of said input apparatus, and presence of a user in proximity of said input apparatus.

9. An electronic lock, comprising:

an input apparatus including a keypad module and a processor module in communication with said keypad module, said keypad module including plural button devices each being operable to output a detection signal, wherein said button devices are arranged in plural rows extending in a first direction and in plural columns extending in a second direction;

a lock mechanism configured to be electrically driven to switch between a lock state and an unlock state; and an electronic controller device in communication with said input apparatus and said lock mechanism, and configured to store a predetermined password, receive a series of input signals from said input apparatus during a time period to compose an input password based on the input signals, compare the input password with the predetermined password, and when the input password matches the predetermined password, drive said lock mechanism to switch from the lock state to the unlock state, wherein said processor module includes a signal-processing unit configured to switch between a sleep mode and a work mode, said signal-processing unit being further configured to, when operating in the work mode, repeatedly perform an emission process of inputting the detection signal to each column of said button devices, wherein in the emission process, said signal-processing unit is to input the detection signal to each column from a first column of the plural columns of said button devices to a last column of the plural columns of said button devices in an order in the first direction, the detection signal including a pulse wave composed of plural pulses, wherein said signal-processing unit is configured to cease performing the emission process in the sleep mode, repeatedly perform a scan process to detect whether the detection signal is outputted from one row of the plural rows of said button devices, wherein the scan process is performed each time the detection signal is inputted to one of said columns of said button devices, and wherein in the scan process, said signal-processing unit is to, for each row from a first row of the plural rows of said button devices to a last row of the plural rows of said button devices in an order in the second direction, attempt to receive the detection signal from the row of said button devices, and when the detection signal outputted from one row of said button devices is detected while said signal-processing unit is inputting the detection signal to one column of said button devices, generate one of the input signals corresponding to one of said button devices that is located in said one row of said button devices and also in said one column of said button devices, and output said one of the input signals thus generated to said electronic controller device, a sleep unit configured to switch said signal-processing unit from the work mode to the sleep mode when no input signal has been outputted by said signal-processing unit for a predetermined time period, and a wake-up unit configured to switch said signal-processing unit from the sleep mode to the work mode when receiving an activation signal.

10. The electronic lock of claim 9, wherein the detection signal has a predetermined time duration, and a total pulse width that is a sum of pulse widths respectively of the plural pulses, and wherein the ratio of the total pulse width to the predetermined time duration is between 20% and 50%.

11. The electronic lock of claim 9, wherein:

said keypad module further includes plural column conducting lines that extend in the second direction, that are spaced apart from each other in the first direction and that correspond respectively to the plural columns of said button devices, and plural row conducting lines that extend in the first direction, that are spaced apart from each other in the second direction and that correspond respectively to the plural rows of said button devices, wherein each of said plural column conducting lines passes across said plural row conducting lines;

each of said button devices corresponds to a different combination of one of said plural column conducting lines and one of said plural row conducting lines, is electrically connected to the corresponding one of said column conducting lines and the corresponding one of said row conducting lines, and is operable, when being touched by a user, to transmit the detection signal received from the corresponding one of said column conducting lines to the corresponding one of said row conducting lines by connecting said corresponding column conducting line and said corresponding row conducting line, in order to output the detection signal on said corresponding row conducting line; and said signal-processing unit includes an emission unit configured to repeatedly perform the emission process to input the detection signal to each column of said button devices by inputting the detection signal to one of said column conducting lines that corresponds to the column of said button devices, in order for each of said button devices in the column of said button devices to receive the detection signal from the one of said column conducting lines, and a detection unit configured to repeatedly perform the scan process to detect the detection signal from one row of the rows of said button devices by receiving the detection signal from one of said row conducting lines corresponding to said one row of said button devices.

12. The electronic lock of claim 11, wherein:

said emission unit is configured to perform the emission process by inputting the detection signal to each column conduction line from a first one of said column conducting lines to a last one of said column conducting lines in an order in the first direction; and said detection unit is configured to perform the scan process by, for each row conducting line from a first one of said row conducting lines to a last one of said row conducting lines in an order in the second direction, attempt to receive the detection signal from the row conducting line, and to stop performing the scan process that is currently performed when receiving the detection signal from said row conducting lines, and then start the scan process again from the first one of said row conducting lines.

13. The electronic lock of claim 12, wherein said emission unit is further configured to stop performing the emission process that is currently performed when said detection unit receives the detection signal from said row conducting lines, and then start the emission process again from the first one of said column conducting lines simultaneously with the starting of the scan process.

14. The electronic lock of claim 9, wherein said signal-processing unit is configured to, when the detection signal outputted from said button devices is detected, stop performing the scan process that is currently performed, and start the scan process again from the first row of the plural rows of said button devices.

15. The electronic lock of claim 14, wherein said signal-processing unit is configured to, when the detection signal outputted from said button devices is detected by said signal-processing unit, stop performing the emission process that is currently performed, and start the emission process again from the first column of the plural columns of said button devices simultaneously with the starting of the scan process.

16. The electronic lock of claim 9, wherein the activation signal is related to one of a user operation of said input apparatus, and presence of a user in proximity of said input apparatus.

* * * * *